United States Patent [19]

Stoll et al.

[11] Patent Number: 4,611,530

[45] Date of Patent: Sep. 16, 1986

[54] OSCILLATING PISTON MOTOR

[76] Inventors: Kurt Stoll, Lenzhalde 72, D-7300 Esslingen; Georg Heid, Kernerstr. 5, D-7120 Bietigheim-Bissingen; Gerhard Schrag, Im Braunkiel 14, D-7305 Altbach; Albrecht Wagner, Bussardstr. 28, D-7065 Winterbach, all of Fed. Rep. of Germany

[21] Appl. No.: 646,319

[22] Filed: Aug. 30, 1984

[30] Foreign Application Priority Data

Aug. 31, 1983 [DE] Fed. Rep. of Germany ..... 3331382
Oct. 14, 1983 [DE] Fed. Rep. of Germany ..... 3337422

[51] Int. Cl.[4] ..... F15B 15/24; F01C 9/00
[52] U.S. Cl. ..... 92/13.5; 92/125
[58] Field of Search ..... 92/120, 124, 128, 125, 92/13.4, 13.41, 13.5; 91/339, 340

[56] References Cited

U.S. PATENT DOCUMENTS

| | | | |
|---|---|---|---|
| 2,209,921 | 7/1940 | Horton | 92/125 X |
| 2,741,702 | 4/1956 | Keen | 92/120 X |
| 2,786,455 | 3/1957 | McDonnell | 92/125 X |
| 3,613,519 | 10/1971 | Southall | 92/125 |
| 3,688,645 | 9/1972 | Reaves | 92/125 |
| 3,890,885 | 6/1975 | Nash | 92/125 |
| 4,263,840 | 4/1981 | Herrera | 92/128 X |

FOREIGN PATENT DOCUMENTS

| | | |
|---|---|---|
| 2808375 | 8/1979 | Fed. Rep. of Germany . |
| 3337422 | 10/1985 | Fed. Rep. of Germany . |
| 652317 | 4/1964 | France . |

*Primary Examiner*—Robert E. Garrett
*Assistant Examiner*—Mark A. Williamson
*Attorney, Agent, or Firm*—McGlew and Tuttle

[57] ABSTRACT

A fluid driven oscillating piston motor is made up of a housing, a shaft mounted in the housing so that it may be oscillated, and a piston running out from the shaft for turning it. The piston divides a space in the housing into two working spaces that are alternately pressurized and relieved of pressure so that the piston is turned through an angle as limited by an adjustable system of stops. The housing is split up into a shell and a lid therefor. Inner faces of the shell engaged by the piston are free or joins because it is made by molding or pressure casting. The shell and the lid are held together by a band with a clamping effect. The piston is joined to the shaft by means of a bush with internal splines fitted into splines of the shaft. A piston seal placed round the shaft is molded in one piece on the oscillating piston.

11 Claims, 5 Drawing Figures

OSCILLATING PISTON MOTOR

BACKGROUND OF THE INVENTION

The present invention relates to fluid drive in the form of an oscillating piston motor.

In the prior art the most various forms of hydraulic and pneumatic rotary drives have been devised, in the case of which the linear motion of a piston and cylinder actuator is converted into a rotary one by way of a transmission designed to convert forms of motion. Such rotary drives have the shortcoming of having to be fitted with a relatively complex transmission. For this reason the mechanical design tends to be involved, they need much space and they are only able to be produced and assembled at a relatively high price.

Furthermore IC engines with oscillating pistons have been put forward in the prior art.

SHORT OUTLINE OF THE PRESENT INVENTION

One object of the present invention is to design an extremely simple and straightforward fluid (viz. hydraulically or pneumatically powered) driven rotary drive that is simple and economic to manufacture. In particular the invention aims at a design of motor that only has a small number of separate parts and which, as far as possible, may be assembled without previous complex fettling operations having to be performed on the separate parts. A still further purpose of the invention is to create a rotary drive that as far as possible is of universal application and more specially makes it possible for a large number of angles of oscillation to be set.

These and other purposes are achieved by a rotary drive comprising a housing, an oscillatory driven shaft bearinged in said housing, a piston drivingly connected to said shaft and dividing a space within said housing into two working spaces, said piston when acted upon by fluid under pressure being able to be moved backwards and forwards though an adjustable angle able to be set by a stop means. Preferred further developments of the invention are defined in the claims.

A detailed account will now be given of the invention and its useful effects on the basis of the working examples to be seen in the figures.

LIST OF THE VARIOUS VIEWS OF THE FIGURES

DETAILED ACCOUNT OF THE WORKING EXAMPLES OF THE INVENTION

Figure 1:
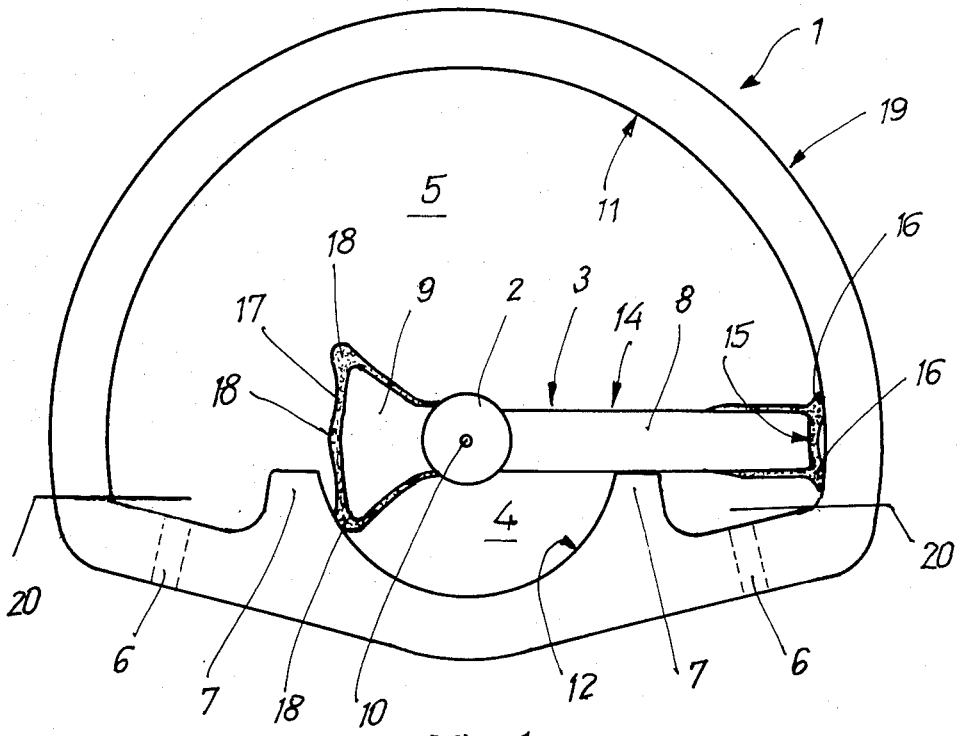
FIG. 1 shows a first working example of the oscillating piston motor in a diagrammatic plan view.

FIG. 1 shows the principal design of the oscillating piston motor of the present invention. The motor has a housing 1 and a shaft 2 bearinged therein for oscillating motion. The shaft 2 is driven backwards and forwards by means of a hydraulic or pneumatic medium (that is to say, a fluid) under pressure, the size of the angle of such motion of the shaft 2 being able to be set within certain limits. The shaft is driven by an oscillating piston 3, that is keyed on the shaft 2. The oscillating piston 3 divides the space in the housing into two working spaces 4 and 5, into each of which there opens a port 6 for the fluid under pressure. When by way of a control circuit (not show) the working space 4 on the one side of the oscillating piston 3 is put under pressure and pressure is let off from the other working space 5, the oscillating piston 3 will be rocked so as to drive the shaft 2. For motion in the opposite direction the supply of fluid under pressure is reversed so that the action of the pressure on the one side of the piston and the discharge of fluid on the other side will be in the opposite direction. The shaft 2 will then be swung in the contrary direction. The shaft 2 protrudes from the housing 1 so that it may be coupled with any desired load, same then being turned by the motor. The angle of turning of the oscillating piston 3 and of the shaft 2 is limited by features that are inherent in the design. In the illustrated working example the maximum angle of rocking is 180°, this proving to be a highly satisfactory angular range for many applications. The angle of rocking is limited by end stops 7 that are molded on the housing 1 as part thereof or are fixed thereto and are in the path of motion of the oscillating piston 3. The oscillating piston 3 runs up against the end stops 7 and is so able to move between the end positions that are 180° apart in the housing, the right hand end position being viewed in FIG. 1. Apart from these end stops 7, there is, as part of the invention, at least one further fixed stop (not shown in detail in FIG. 1) making it possible to set a range of oscillation that is smaller than 180°.

In FIG. 1 it will be seen that the oscillating piston has the form of a first class lever arm 8 whose pivot at one end is formed by the shaft 2. There is furthermore a short head 9 on the piston. The length of the arm 8 running out from the shaft may be designed with greatly different values in keeping with specific requirements. The arm 8 of the oscillating piston 3 projects from one side of the shaft 2 and is relatively long and forms most of the surface of the piston acted upon by the fluid. The short head 9 on the other side of the shaft 2 only has the function of forming a seal completing the division of the two working spaces 4 and 5 from each other. When one of the the working spaces 4 and 5 is pressurized by the fluid, a torque well be transmitted by the head 9 to the shaft 2 that is opposite in direction to the driving torque exerted by way of the arm 8. Such an opposite torque is naturally undesired and attempts will be made to make the effective piston area of the arm 8 very large and that of the head 9 as small as possible so that it may be neglected. Theoretically ideal force relationships will be produced if the shaft 2 has a very small diameter and if the oscillating piston is in the form of a lever running out from one side of the pivot axis 10 of the shaft 2 without any head 9 thereon. However in practice the shaft naturally has to be of finite thickness for reasons of strength so that there will then furthermore be a surface on which forces opposing the direction of drive may act upon. Although in theory it would be possible for a seal between the working spaces 4 and 5 to be on the shaft 2 itself, the design is then made complex and furthermore the connection of the shaft 2 to the oscillating piston 3 is very much simpler, if the piston is not made in the form of a single arm integral with the shaft but rather one that fits through an opening in the shaft 2. Although in this case there is the certain amount of opposite torque reducing the driving force of the oscillating piston motor, if the head 9 is suitably designed so as to have an acceptable size, the undesired effect is minimized.

When the piston 3 is oscillating, the arm 8 and the head 9 will run on part-cylindrical inner wall faces of the housing 1 to make sealing engagement therewith. Such inner wall faces 11 and 12 are coaxial to the axis 10 of the shaft 2 and the inner wall face 11 engaged by the arm 8 has a very much larger diameter than the inner wall face 12 on which the head 9 sealingly runs. The two inner wall faces 11 and 12 are curved in opposite directions and are concave towards each other. The angle subtended by the inner wall faces 11 and 12 is generally equal to the angle of turning of the oscillating piston 3, viz. in the present case 180°. Small departures in this respect will be due to the thickness of the oscillating piston 3 and the design of its seals. It will be seen that there is a seal body 13 at the end of the arm 8 placed on the two side faces 14 and the end face 15 of the arm 8. THis seal body 13 has two laterally projecting lips 16 running on the inner wall face 11, that subtends an angle of somewhat over 180° in order to make it possible for the sealing body 13 to make sealing engagement in the end positions of the oscillating piston 3 as well. On the other hand the inner wall face 12 which the head 9 runs on subtends an angle of somewhat less than 180°. It is positioned between the end stops 7 and the head 9 is covered over by the sealing body 17, same projecting into the space between the stops 7 in the end positions of the oscillating piston 3. The sealing body 17 has a form flaring out in a direction away from the shaft 2 and having on its outer end three symmetrically placed sealing lobes. Whereas in the intermediate positions of the oscillating piston 3 all the sealing lobes 18 run effectively on the inner wall face 12, in the end positions only one of the lobes 18 will be effectively running on the inner wall face 12 which protrudes furthest to the one side of the oscillating piston 3 towards the inner wall face 12. The oscillating piston 3 is furthermore designed to make sealing contact with the two faces or end plates of the motor housing that are parallel to the plane of the FIG. 1.

The outline of the housing 1 is generally in keeping with the form of the inner wall faces 11 and 12 on which the oscillating piston 3 runs with a sealing effect. In the range swept by the head 9 the outer face 19 of the housing 1 has a semi-circular plan form as well. In the opposite section on the other hand the outer face of the housing 1 is triangular, the limbs of the triangle being at an obtuse angle to each other with the semi-circular inner wall face 12 with the head 9 running on it between them. The housing 1 is cylindrical and centered on the base surface so defined, the generatrix of the cylinder being perpendicular to the plane of FIG. 1. The housing may be designed with different heights in keeping with the desired piston area. In the interests of producing a high driving torque one will however prefer a low form such that the height of the housing 1 is smaller than the radial extent of the oscillating piston 3. The oscillating piston motor described has a very small overall size, and, in comparison with the size of the housing, the driving torque is very large. Useful effects that make themselves felt during the course of manufacture of the motor is produced are to be had if the housing 1 is divided upon into a semi-cylindrical shell 21 and a lid 22 with a parting plane or joint 20 therebetween. The division into the two parts is such that the said shell 21 has the inner wall face 11 on which the arm 8 runs, and the lid 22 has the inner wall face 12 sealingly engaged by the head 9. Such a design means there are no housing joints in the sealing faces engaged by the oscillating piston 3, and on the other hand the oscillating drive of the invention is then very easily assembled. If in keeping with a preferred form of the invention the shell 21 and/or the lid 22 is made integrally without machining, viz. by molding resin or by zinc pressure casting, the parts may be demolded at the parting plane 20 so that the running faces of the oscillating piston 3 will be completely free of flash and no deburring or other fettling operations will be needed. It will be clear that such a method of manufacture will involve only low costs.

Figure 2:
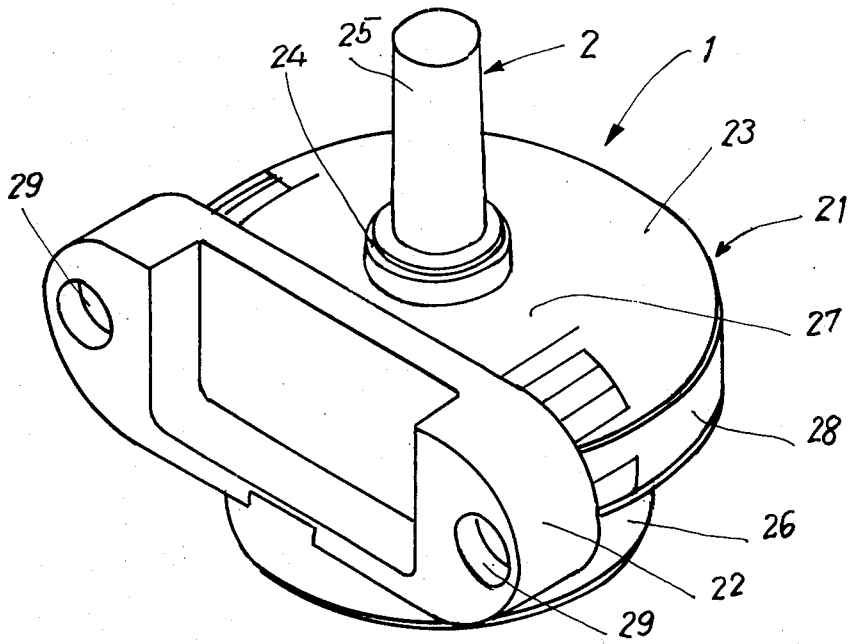
FIG. 2 is a perspective view of the housing of a second design of the oscillating piston motor incorporating the present invention.

Referring now to the FIGS. 2 to 5 the reader will see a further working example of the oscillating piston motor of the invention with more technical details. Firstly FIG. 2 shows a somewhat modified form of the housing 1, that is again made up in the form of a shell 21 and a lid 22 closing the shell 21. The shell 21 has a semi-cylindrical part 23, coaxial with the shaft 2. The shaft 2 is supported in bearing bushes 24, that are molded on the shell 21. The two ends of the shaft 2 project from the shell 21, one free end 25 being for coupling with a load, not shown, to be driven. The other end of the shaft 2 has a stop means 26 thereon, that makes it possible for the angle of turning of the oscillating piston 3 and of the shaft 2 to be adjusted. Next to the semi-cylindrical part 23 on the lid side there is a continuation 27 of the shell 21. This continuation is molded in one piece with the shell 21 so that there is a smooth transistion between them. It gives the shell a form which is like a truncated oval in section, while the shell 21 is generally cylindrical when looked at normal to this section.

At the semi-cylindrical part 23 and in the vicinity of the continuation 27 the outer limit 28 of the shell 21 is closed, while on the other hand the flat back side of the shell 21 opposite to the semi-cylindrical part is open so that the oscillating piston 3 may be put in through this side. When the oscillating piston 3 has been fitted, the opening is shut off by the lid 22.

The shell 21 and the lid 22 are clamped together by means of a band, as will be described, running round the outer limit 28 of the shell 21. The band is fixed by two fasteners to the lid 22, in which respect two assembly holes 29 in the lid 22 will be seen in FIG. 2. The holes 29 are at the same level as the outer limit 28 and the fasteners are fitted into them from the back side of the lid 22.

Figure 3:
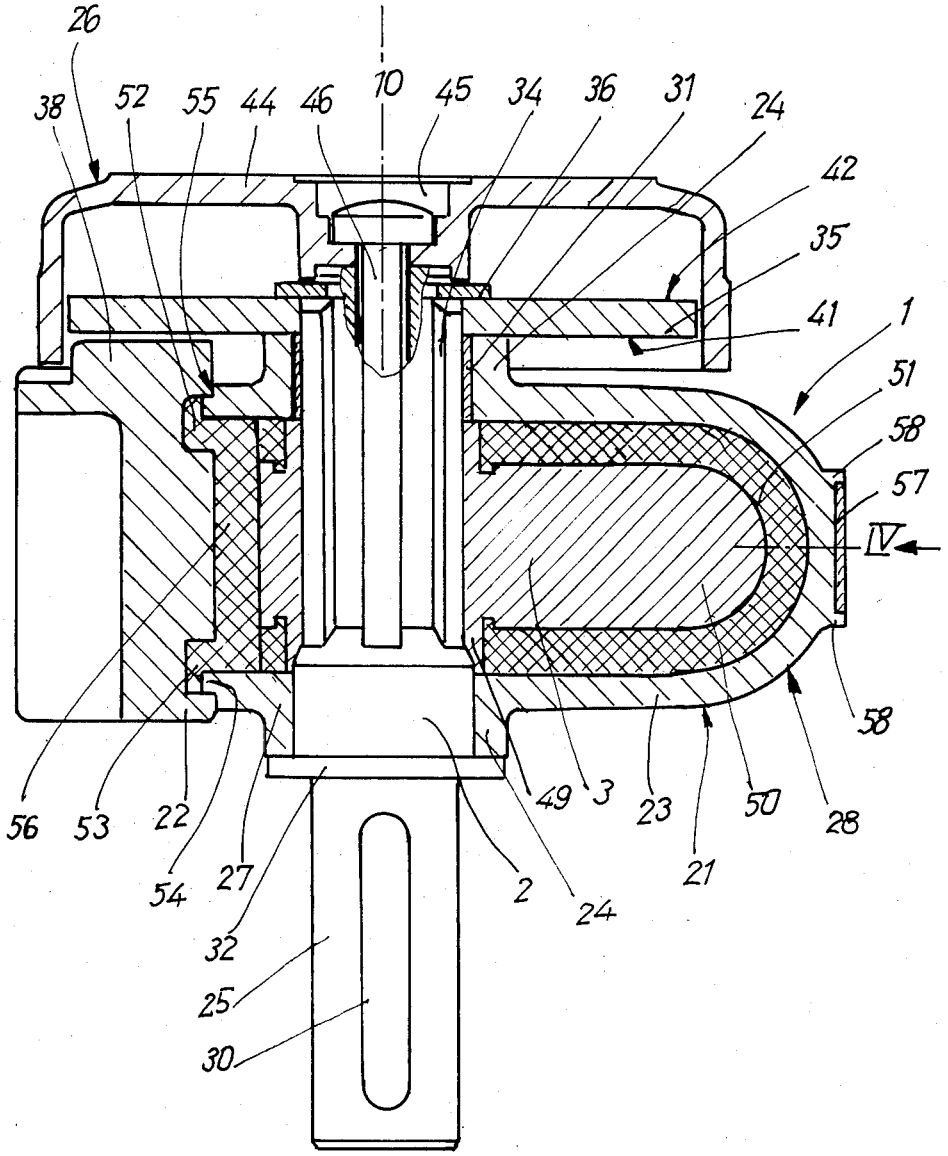
FIG. 3 is a lengthways section through this oscillating piston motor.

FIG. 3 shows the oscillating piston motor in section, the free end 25 of the shaft 2 now being seen to be running out in a downward direction. This end has a projecting driving dog 30 extending in an axial direction so that the end 25 is not round in form. A load may be readily coupled, possibly with the use of an intermediate member, with this dog 30. The shaft 2 fits into the bearing bushes 24, there being a guide sleeve 31 in one bearing bush 24. The depth to which the shaft 2 may be pushed into the housing 1 is limited by means of a collar 32, that comes to rest against one end of one of the bearing bushes 24 and on the opposite side of the housing the shaft 2 is rested against the housing, there being a stop means 26 acting as a retainer so that it may not be disconnected.

The shaft 2 has external splines 34 running along part of its length as will be seen unsectioned in FIG. 3. The splines are stepped and the sides of the splines are generally radial. The splines 34 serve to make a torquetransmitting connection between the shaft 2 and the oscillating piston 3 and a disk 35 of the stop means 26. The end of the shaft 2 opposite to its free end 25 is splined and projects out of the bearing bush 24 of the housing 1. On the edge of a middle hole the disk 35 has mating teeth so that it may be locked on the shaft 2 and the disk then rests against the end of the bearing bush 24. In this position it is retained by a circlip 36 on the shaft 2. The circlip 36 is taken up in a groove running round the shaft 2. Apart from the driving connection between the shaft 2 and the disk 35 it will be seen that this arrangement secures the shaft 2 in the housing 1 in which it is bearinged.

There is at least one stop body 37 (see FIG. 4) mounted on the disk 35, on which it may be adjusted angularly. The stop body 37 may more specially have the form of a sector so that its face turned away from the shaft will be part-circular and will have two radial faces stretching out from it towards the shaft. The stop body 37 runs up against a counter-stop 38 (see FIG. 3), fixed in relation to the housing 1, for limiting the angle of oscillation of the motor of the present invention. The said counter-stop 38 is in the present example of the invention molded on the lid 22. The counter-stop 38 has the same sector form as the stop body 37. One single stop body 37 only will be required to limit and set the permitted angle of oscillation of the motor of the invention, although as a general point it is preferred to have an arrangement with two stop bodies 37 limiting the angle of motion, such bodies 37 being placed on two opposite sides of the counter-stop 38.

For adjustment of the stop bodies 37 there is one slot machined in the disk 35 for each body, such slots being curved and being centered on the axis 10 of the shaft 2. The stop bodies 37 are made up of two pads 40 that may be adjusted in relation to each other and are mounted on two sides of the disk 35. The necessary clearance on the lower side 41, i.e. the side of the disk 35 facing the housing 1, is ensured by having disk 35 resting against the projecting bush 24. The clearance is only reduced in the part next to the counter-stop 38, same projecting as far as a point close to the lower side 41 of the disk 35. The pad 40 mounted on this lower side 41 of the stop bodies 37 has a threaded hole that is in line with the slot 39 in the disk 35. There is a screw 43 running from the top side 42 of the disk 35 into the threaded hole, such screw engaging the other pad 40 and fixing the stop body firmly on the disk. The stop body 37 may be steplessly adjusted in the slot 39 so that adjustment of the angle of turning of the oscillating piston motor is possible.

In keeping with a preferred form of the invention the disk 35 with the stop bodies 37 is covered over by a shroud 44 that is held on the shaft 2 and turns therewith. This shroud 44 rounds off the outline of the housing 1 and at the same time keeps dirt and any other foreign matter out of the stop means 26, which which would otherwise be likely to get in the way of it. The shroud 44 has a clearance between it and the disk 35 over which it is fitted so that there is a space for the stop bodies 37. It runs with a small gap over the surface of the housing 1 and for fixing on to the shaft the shroud 44 has a central pocket 45, into which a screw 46 may be placed. The screw 46 is screwed into a threaded blind hole in the shaft 2 on its axis. To make sure that the shroud 44 is not able to be turned in relation to the shaft there may be interlocking structures like a groove and tongue joint. Preferably a tooth or the like (not shown) is formed on and inside the shroud 44 and fits into a notch on the outer edge of the disk 35.

Figures 4, 5:
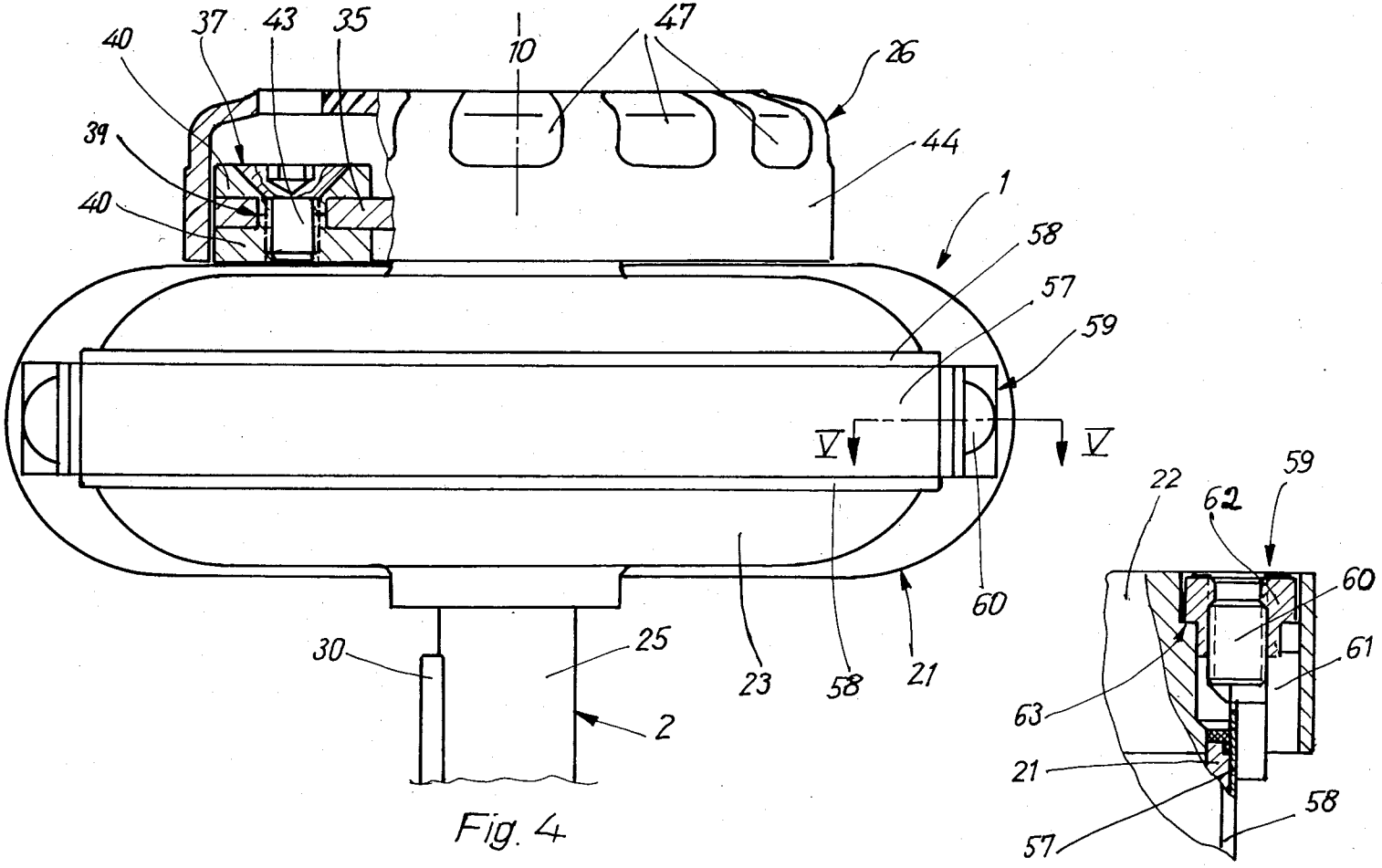
FIG. 4 is a front view of the oscillating piston motor looking in the direction marked IV in FIG. 3.
FIG. 5 is a view of a part of the motor of FIG. 4 as part of a section taken on the line V—V.

As will be seen from FIG. 4, the shroud 44 has openings 47 in its top part to put a tool through for adjustment of the stop bodies 37. The openings 47 may for example follow the form of the slots 39 in the disk 35 so that they are curved and centered on the axis of the shroud 44. However other forms of openings 47 are possible. A screwdriver may be put through one of the openings 47 to turn one of the screws 43 by which the stop bodies are fixed to the disk 35. The screws 43 may be slackened off, the stop bodies 37 adjusted on the disk 35 and the screws 43 then done up tight again.

In FIG. 3 the reader will again be able to see the two-part structure of the housing 1 made up of the shell 21 and the lid 22 covering it. Most of the sliding face of the oscillating piston 3 runs on the inner face of the shell 21 and there are means producing a seal between the piston and the shell 21 and between the piston and the lid. The oscillating piston 3 is made up of a bush 49 that is locked on the shaft 2 and an arm 50 molded on and running radially out from the bush 49. Internally the bush 49 has splines mating with splines on the shaft 2. The splines on the bush are in this form of the invention as well stepped with the sides of the splines running generally radially. The oscillating piston 3 may so be locked with the bush 49 on the shaft 2 and is then drivingly joined thereto.

For producing a seal between the oscillating piston and the shell 21 there is a seal 51. This seal is mounted on the outer edge of the arm 50 and is furthermore placed round the shaft 2 in the vicinity of the bush 49. For this purpose the bush 49 has a ring-like peripheral step on each of its two axial faces to take up the seal 51. The sealing parts on the end faces of the bush 49 are joined up by way of the sealing part on the outer edge of the arm 50. Preferably the whole seal 51 is made in one piece and able to be positively keyed inn the outer face of the oscillating piston 3. More specially, the seal 51 may be molded on the oscillating piston 3 of synthetic resin.

Furthermore there are sealing means between the oscillating piston 3 and the lid 22 in the vicinity of the shaft. As for details, it will be seen that the bush 49 has a part of its face, turned away from the arm 50, running on a seal 52, that is fixed to the lid 22. It will further be seen that in this way it is possible to get a sealing action on all sides of the oscillating piston 3 and that there will be a complete sealing off of the working spaces 4 and 5 inside the housing 1. The seal 52 between the oscillating piston 3 and the lid 22 is in the present working example of the invention placed between the shell 21 and the lid 22. It has a flange-like part 53 locked in a groove in the lid 22 and in this respect covers the floor and the inner face of the groove. Between the outer wall of the groove and the seal 52 there is on the other hand a clearance to take up the edge 54 of the shell 21. The said edge 54 of the shell 21 presses the seal 52 into the groove, the depth of motion of the shell 21 into the groove being limited by a step 55 on the outer edge of its end face. This step 55 keeps the shell 21 lined up with the lid 22.

Between the flange-like parts 53 of the seal 52 there is a sealing lip 56 on which the bush 49 of the oscillating piston 3 runs. The design in keeping with the invention makes it possible for one and the same seal 52 to be used both for sealing the oscillating piston 3 and also for the necessary sealing action between the shell 21 and the lid 22. In such a design the seal 52 has its flange-like part 53 running over the full edge of the shell 21, and the groove, taking up the seal 52, in the lid 22 is shaped to be in line with the outer form of the shell 21 in the vicinity of its edge 54. It is more specially possible for the groove to have an oval form.

The shell 21 and the lid 22 of the housing 1 are clamped together with a locking effect. This is furthermore responsible for producing the necessary pressing force on the seal 52 inbetween the other parts at the same time. For getting the clamping force there is a band 57 that is preferably made of steel. The band 57 is mounted between two ribs 58, that are parallel to each other and are formed on the outer edge of the shell 21. The band takes up all the space the space between the ribs 58 so that the housing 1 has a smooth outer surface. The band 57 has one fastener 59 (see FIG. 5) at each end to keep it in place on the lid 22. The fasteners 59 each have a pin 60, that is fixed to one end of the band 57 in each case. The pin 60 may for example be soldered or more specially brazed to the band 57. The end of the pin 60 furthest from the band 57 is taken up in a counterbored hole 61 in the lid 22. The pin 60 is externally threaded and a nut 62 is screwed onto it, the nut running in the wider part of 63 of the hole 61 and resting against a shoulder formed thereon. By turning the nut 62 with a suitable tool the pin 60 will be moved axially (since it is fixed to the band 57 and cannot turn) and the band 57 may be tightened. Because both of the ends of the band 57 are fixed to fasteners 59 the pulling force may be equally transmitted to the shell 21 and the lid 22 and any non-alined motioned of these parts during assembly is effectively guarded against. The band connection of the invention is simple in design, low in price and quite secure. More specially in the case of a housing made of metal as for example pressure-cast zinc, it is however possible to have other forms of joint, as for example a screw joint.

Referring once again to FIG. 3 its will be seen that the shell 22 is made up of a generally semi-cylindrical part 23 and a continuation 27 formed thereon, that runs out past the middle part of the cylinder with the axis 10 of the turning of the oscillating piston 3 therein, and has guide sleeves 31, bearing eyes or the like bearing means for the shaft 2. The shell 21 is made in one piece in all the sealing and operating parts of the oscillating piston 3. More specially, there are no housing seals in the surface on which the oscillating piston arm 50 runs. The shell 21 may be produced free of flash or other projections using resin or die cast metal, the casting or molding being removed from the opening that is covered over by the lid 22. This form of production is more specially attractive from the price angle and gives the beneficial effect that the sealing part of the oscillating piston 3 does not have to be fettled otherwise prepared after being molded. The radial outer side of the shell 21 is rounded off in the present working example of the invention; only the part between the ribs 58 taking up the band 57 offers a flat support surface. The arm 50 of the oscillating piston 3 is made oval to be in conformity with the outline of the shell 21. The lid 22 is generally flat and has two connections for fluid under pressure that are not shown in detail and open into respective working spaces 4 and 5 separated from each other by the oscillating piston 3.

In its structure the oscillating piston motor of the invention is extremely compact and only needs a very small number of separate parts. As compared with conventional designs with a toothed pinion there is a saving in space of about 50% and a saving in costs of the order of 30%. Assembly of the oscillating piston motor is extremely simple. The oscillating piston 3 is placed in the shell 21, the shaft 2 pushed into and through the splined bush 49, the stop means 26 mounted and the shell 21 covered with the lid 22. In a modified form of the invention is furthermore quite readily possible to do without a stop means 26 and in addition the oscillating piston motor may be fitted with integrated signal pick-ups or detectors for pneumatic or electrical control. The stepless adjustment of the range of motion of the oscillating piston makes possible universal application of the motor as a hydraulic or pneumatic rotary drive. It is preferred to have an adjustable maximum angle of turning of 180°, to which end the separate components are preferable designed for an angle of turning of slightly more than 180° so as to allow for manufacturing inaccuracies. Fields of application are the opening and closing of doors, windows, hatch doors such as the hatch doors of silos and fittings. Furthermore the motor of the present invention may be used for a large number of applications for moving parts of machines such as in conveying systems for moving switches, opening valves and closing them again, tightening and slackening off vises and the like. Other uses for the oscillating piston motor may be seen in arms of robots, manipulators, transfer, turning and stamping stations and for the operation of stirring and bending or lifting apparatus. Round stepping tables with a limited angle of turning may be operated with a single oscillating piston motor of the present invention. In the case of the preferred use of a number of intermittent operating oscillating piston motors acting on a common shaft it is possible for an element to be slowly rotated. Further applications are to be seen in harmonic linear drives, drives for automobile screen washers and for use as pneumatic rotary springs.

We claim:

1. A fluid operated oscillating piston motor comprising a housing defining a space, a shaft rotatably mounted to said housing and extending through said space for oscillating motion about a shaft axis, an oscillating piston connected to said shaft and extending in said space, said piston dividing said space into two working spaces, port means connected to said housing and communicating with said working spaces for admission of fluid under pressure to said working spaces, a disk keyed to said shaft outside said space, at least one stop body adjustably mounted on said disk, and a stop connected to said housing and engageable by said stop body with rotation of said shaft to limit motion of said stop body and said shaft.

2. The oscillating piston motor as claimed in claim 1, wherein said disk has an arcuate slot therein, said slot body being mounted in said arcuate slot.

3. The oscillating piston motor according to claim 1, wherein said stop body and said stop are positioned with respect to each other and shaped for establishing a maximum angle of rotation of about 180° for said shaft.

4. The oscillating piston motor as claimed in claim 1 comprising two such stop bodies mounted on said disk and able to be fixed at different postions along a curved slot in said disk.

5. The oscillating piston motor as claimed in claim 1 comprising a shroud covering said disk and said stop body and fixed on said shaft.

6. The oscillating piston motor as claimed in claim 5 wherein said shroud has tool access openings.

7. The oscillating piston motor as claimed in claim 1, wherein said housing comprises a shell defining said space, a lid engaged with said shell and covering said space, a band engaged around said shell and at least one fastener connected between said band and said lid for holding said band around said shell and to said lid.

8. The oscillating piston motor as claimed in claim 7 wherein said port means are located in said lid and said shell has a rounded outer face.

9. The oscillating piston motor as claimed in claim 7 wherein said shell has a generally semi-cylindrical part and a continuation formed thereon running over a central plane of the semi-cylinder and having bearing means for the said shaft.

10. The oscillating piston motor as claimed in claim 7, wherein said band has two ends, one of said ends connected to said fastener and including a second fastener connected between the opposite end of said band and said lid.

11. The oscillating piston motor as claimed in claim 10, wherein said shell includes a pair of spaced-apart ribs, said band engaged between said ribs.

* * * * *